US009383690B1

(12) United States Patent
Tominaga

(10) Patent No.: US 9,383,690 B1
(45) Date of Patent: Jul. 5, 2016

(54) TRANSFER DEVICE AND IMAGE FORMING APPARATUS

(71) Applicant: FUJI XEROX CO., LTD., Tokyo (JP)

(72) Inventor: Yoshiyuki Tominaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/799,138

(22) Filed: Jul. 14, 2015

(30) Foreign Application Priority Data

Feb. 16, 2015 (JP) ..... 2015-027708

(51) Int. Cl.
*G03G 15/16* (2006.01)
*G03G 15/00* (2006.01)

(52) U.S. Cl.
CPC ..... *G03G 15/1675* (2013.01); *G03G 15/163* (2013.01); *G03G 15/16* (2013.01); *G03G 15/1605* (2013.01); *G03G 15/80* (2013.01)

(58) Field of Classification Search
CPC ..... G03G 15/1675
USPC ..... 399/66, 314
See application file for complete search history.

(56) References Cited

U.S. PATENT DOCUMENTS

2006/0099016 A1* 5/2006 Watanabe et al. ..... 399/351
2009/0142087 A1* 6/2009 Iimura ..... 399/74
2011/0318682 A1* 12/2011 Takahashi et al. ..... 430/105
2013/0148993 A1* 6/2013 Aoki et al. ..... 399/66

FOREIGN PATENT DOCUMENTS

JP 2000-298408 A 10/2000
JP 2001-194929 A 7/2001

* cited by examiner

*Primary Examiner* — Benjamin Schmitt
(74) *Attorney, Agent, or Firm* — Sughrue Mion, PLLC

(57) ABSTRACT

A transfer device includes an endless rotating member that rotates; a first transfer section that transfers a toner image, which is formed by a first forming unit by using a flat toner containing a flat metallic pigment, onto an outer periphery of the rotating member; a second transfer section that transfers a toner image, which is formed by a second forming unit by using a non-flat toner, onto the outer periphery; a ground-connected section that is disposed downstream of the first transfer section in a rotating direction of the rotating member and that is connected to ground by being in contact with an inner periphery of the rotating member; and a power supply that applies an electric current to the first transfer section, which is lower than an electric current applied to the second transfer section, when the first transfer section transfers the toner image onto the outer periphery.

8 Claims, 8 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2015-027708 filed Feb. 16, 2015.

BACKGROUND

Technical Field

The present invention relates to transfer devices and image forming apparatuses.

SUMMARY

According to an aspect of the invention, there is provided a transfer device including an endless rotating member that rotates; a first transfer section that transfers a toner image, which is formed by a first forming unit by using a flat toner containing a flat metallic pigment, onto an outer periphery of the rotating member; a second transfer section that transfers a toner image, which is formed by a second forming unit by using a non-flat toner, onto the outer periphery; a ground-connected section that is disposed downstream of the first transfer section in a rotating direction of the rotating member and that is connected to ground by being in contact with an inner periphery of the rotating member; and a power supply that applies an electric current to the first transfer section, which is lower than an electric current applied to the second transfer section, when the first transfer section transfers the toner image onto the outer periphery.

BRIEF DESCRIPTION OF THE DRAWINGS

Exemplary embodiments of the present invention will be described in detail based on the following figures, wherein.

DETAILED DESCRIPTION

General Outline

An exemplary embodiment of the present invention will be described below. First, the configuration of an image forming apparatus 10 according to this exemplary embodiment (see FIG. 1) and toners used in the image forming apparatus 10 (see FIGS. 4 and 5) will be described. Subsequently, an image forming operation of the image forming apparatus 10 according to this exemplary embodiment will be described. Then, the effects of this exemplary embodiment will be described. In the following description, a direction indicated by arrows X and −X will be defined as an apparatus width direction, and a direction indicated by arrows Y and −Y will be defined as an apparatus height direction. Furthermore, a direction orthogonal to the apparatus width direction and the apparatus height direction (i.e., direction indicated by arrows Z and −Z) will be defined as an apparatus depth direction.

Configuration of Image Forming Apparatus

Figure 1:
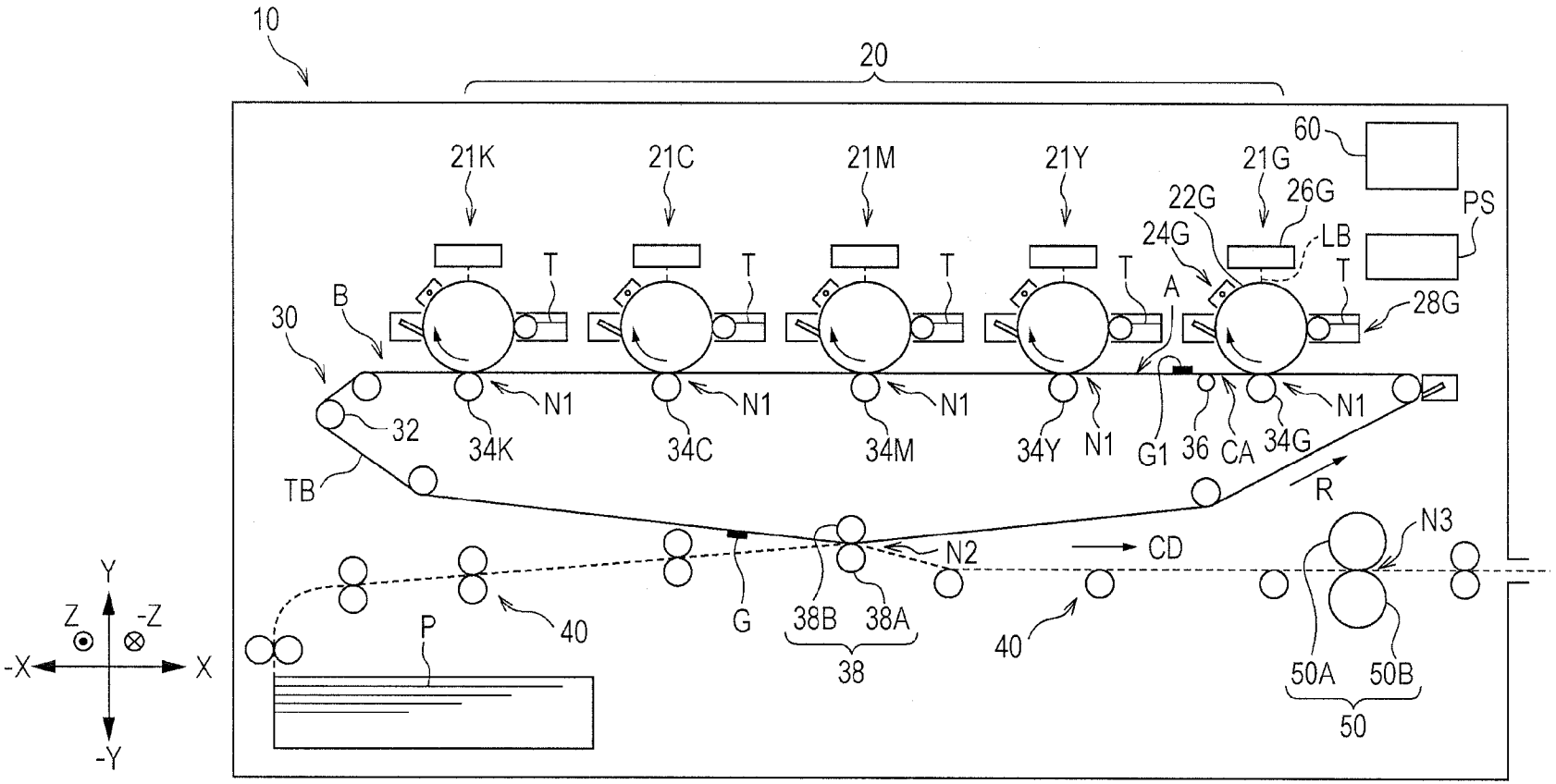
FIG. 1 is a front view schematically illustrating an image forming apparatus according to an exemplary embodiment.

The image forming apparatus 10 according to this exemplary embodiment has a function of receiving job data, which will be described later, from an external apparatus (not shown) and forming an image onto a medium P (e.g., a paper medium). Furthermore, the image forming apparatus 10 according to this exemplary embodiment is, for example, an electrophotographic apparatus. As shown in FIG. 1, the image forming apparatus 10 includes a toner-image forming section 20, a transfer device 30, a transport device 40, a fixing device 50, and a controller 60.

Toner-Image Forming Section

The toner-image forming section 20 has a function of performing a charging step, an exposure step, and a developing step so as to form toner images G (see FIG. 1), which will be described later, onto photoconductors 22 (see FIG. 1), which will be described later.

As shown in FIG. 1, the toner-image forming section 20 includes monochromatic units 21G, 21Y, 21M, 21C, and 21K that individually form toner images G of different colors (i.e., gold (G), yellow (Y), magenta (M), cyan (C), and black (K) colors). The monochromatic units 21G, 21Y, 21M, 21C, and 21K are arranged in this written order from the upstream side toward the downstream side in the rotating direction (i.e., direction indicated by an arrow R) of a transfer belt TB, which will be described later, with reference to a nip N2, which will be described later. From a different perspective, the monochromatic units 21G, 21Y, 21M, 21C, and 21K are arranged in this written order from the X side toward the −X side. Other than the fact that the monochromatic units 21G, 21Y, 21M, 21C, and 21K form different-colored toner images G, the monochromatic units 21G, 21Y, 21M, 21C, and 21K have identical configurations. In the following description and the drawings, if the monochromatic units 21G, 21Y, 21M, 21C, and 21K and the components thereof are not to be distinguished from one another, the alphabetical suffixes will be omitted. In the following description, a toner image G formed by the monochromatic unit 21G will be defined as a toner image G1, and toner images G formed by the monochromatic units 21 other than the monochromatic unit 21G will be defined as toner images G2. However, if the toner images G1 and G2 are not to be distinguished from each other, the toner images G1 and G2 will be described as toner images G.

The monochromatic unit 21G forms the toner image G1 onto a photoconductor 22G, which will be described later, by using flat toner (referred to as "toner MT" hereinafter, see FIG. 4). The monochromatic units 21 other than the monochromatic unit 21G individually form the toner images G2 onto the photoconductors 22 other than the photoconductor 22G by using non-flat toner (referred to as "toner NT" hereinafter, see FIG. 5). The monochromatic unit 21G is an example of a first forming unit, whereas the monochromatic units 21 other than the monochromatic unit 21G are an example of second forming units. The toner MT and the toner NT in this exemplary embodiment have, for example, a negative polarity (i.e., the average of electric-charge distribution is negative). In the following description, if the toner MT and the toner NT are not to be distinguished from each other, the toner MT and the toner NT will be described as toner T.

Figure 2:
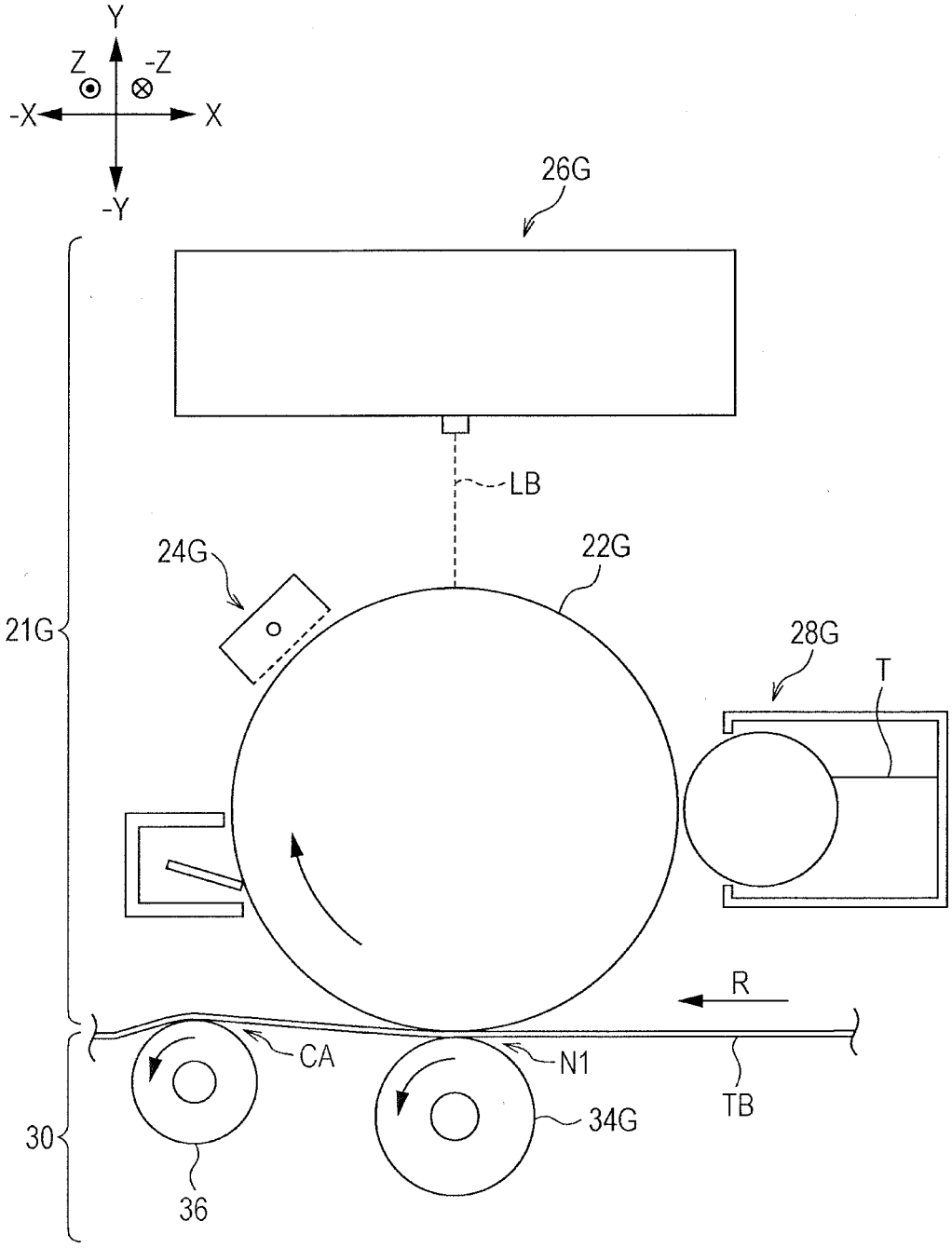
FIG. 2 is a front view schematically illustrating a monochromatic unit of a toner-image forming section and a part of a transfer device, which constitute the image forming apparatus according to the exemplary embodiment.

As shown in FIG. 1, each monochromatic unit 21 includes a cylindrical photoconductor 22, a charging device 24, an exposure device 26, and a developing device 28. Although FIG. 2 schematically illustrates the monochromatic unit 21G and a part of the transfer device 30, the monochromatic units 21 other than the monochromatic unit 21G each have a configuration identical to that of the monochromatic unit 21G in FIG. 2. The charging device 24 electrostatically charges the photoconductor 22, the exposure device 26 exposes the photoconductor 22 to light (i.e., forms a latent image on the photoconductor 22 by using light LB), and the developing device 28 develops a toner image G (i.e., develops the latent image into a toner image G), whereby the toner image G is formed. In FIG. 1, the reference characters of components of the monochromatic units 21 other than the monochromatic unit 21K have been omitted. Moreover, the photoconductors 22 are ground-connected to a frame (not shown) of the image forming apparatus 10.

Transfer Device

The transfer device 30 has a function of transferring (first-transferring) the toner images G formed on the photoconductors 22 by the monochromatic units 21 onto (the outer periphery of) the rotating transfer belt TB at nips N1, which will be described later, and also has a function of transferring (second-transferring), at the nip N2, the toner images G first-transferred on the transfer belt TB onto a medium P transported to the nip N2, which will be described later.

As shown in FIG. 1, the transfer device 30 includes a part of the controller 60 (i.e., controller 60A), the transfer belt TB, a drive roller 32, first-transfer rollers 34G, 34Y, 34M, 34C, and 34K, a power supply PS, an auxiliary roller 36, and a second-transfer unit 38.

In the following description, if the first-transfer rollers 34G, 34Y, 34M, 34C, and 34K are not to be distinguished from one another, the alphabetical suffixes will be omitted.

Controller 60A

The controller 60A has a function of controlling sections other than the controller 60A constituting the transfer device 30 (which will be referred to as "the transfer device 30 other than the controller 60A" hereinafter). The controller 60A according to this exemplary embodiment controls the transfer device 30 other than the controller 60A in accordance with, for example, ten kinds of modes (i.e., first to tenth modes, see FIG. 3). The first to tenth modes will be described later in the description of the controller 60.

Transfer Belt and Drive Roller

The transfer belt TB is an endless belt. The drive roller 32 rotates about a shaft by being driven by a driving source (not shown) so as to cause the transfer belt TB to rotate in the direction of the arrow R. Then, the transfer belt TB rotates while carrying, on the outer periphery thereof, the toner images G formed and first-transferred on the photoconductors 22 by the monochromatic units 21, so as to bring the toner images G to the nip N2. The transfer belt TB is an example of a rotating member.

First-Transfer Rollers

The first-transfer roller 34G has a function of first-transferring the toner image G1 formed on the photoconductor 22G by the monochromatic unit 21G onto (the outer periphery of) the rotating transfer belt TB at the corresponding nip N1. The first-transfer rollers 34 other than the first-transfer roller 34G have a function of first-transferring the toner images G2 formed on the photoconductors 22 other than the photoconductor 22G by the monochromatic units 21 other than the monochromatic unit 21G onto (the outer periphery of) the rotating transfer belt TB at the corresponding nips N1.

The first-transfer rollers 34 are electrically-conductive rollers having identical structures. The first-transfer rollers 34G, 34Y, 34M, 34C, and 34K are respectively disposed below the monochromatic units 21G, 21Y, 21M, 21C, and 21K with the transfer belt TB interposed therebetween. Therefore, the first-transfer rollers 34G, 34Y, 34M, 34C, and 34K are arranged in this written order from the upstream side toward the downstream side in the moving direction of the transfer belt TB with reference to the nip N2. Specifically, with reference to the nip N2, the first-transfer roller 34G is disposed upstream of the first-transfer rollers 34 other than the first-transfer roller 34G in the moving direction of the transfer belt TB. The first-transfer roller 34G is an example of a first transfer section, and the first-transfer rollers 34Y, 34M, 34C, and 34K are an example of second transfer sections.

The first-transfer rollers 34 are pulled downward by tension springs (not shown) and are vertically movable by cams (not shown) controlled by the controller 60A. Each first-transfer roller 34 is positionally movable between a non-contact position at which the first-transfer roller 34 is positioned away from the transfer belt TB and a contact position at which the first-transfer roller 34 comes into contact with the transfer belt TB and sandwiches the transfer belt TB together with the corresponding photoconductor 22 so as to form the nip N1 between the photoconductor 22 and the transfer belt TB. The first-transfer rollers 34 in FIG. 1 and the first-transfer roller 34G in FIG. 2 are disposed at the contact position. Each first-transfer roller 34 is set at either the non-contact position or the contact position in accordance with each mode of the controller 60A.

Power Supply

The power supply PS has a function of applying voltage (first-transfer voltage) to the first-transfer rollers 34 disposed at the contact position so as to cause an electric current to flow through the first-transfer rollers 34. Furthermore, the power supply PS also has a function of applying voltage (second-transfer voltage) to a backup roller (BUR) 38B, which constitutes the second-transfer unit 38 and will be described later, so as to cause an electric current to flow through the BUR 38B. The electric current caused to flow through the first-transfer rollers 34 by the power supply PS is an electric current flowing through the frame of the image forming apparatus 10. In this case, the current path extends from the first-transfer rollers 34 to the photoconductors 22 disposed facing the first-transfer rollers 34 with the transfer belt TB interposed therebetween. The power supply PS causes the electric current to flow through the aforementioned current path in accordance with each mode (i.e., each of the first to tenth modes mentioned above) of the controller 60A.

Auxiliary Roller

The auxiliary roller 36 has a function of pressing against the transfer belt TB and coming into contact with the inner periphery of the transfer belt TB so as to make the nip N1 formed between the photoconductor 22G and the transfer belt TB stable (i.e., assist in the formation of the nip N1). An area in the transfer belt TB that the auxiliary roller 36 is in contact with is called a contact area CA (see FIG. 2 and FIGS. 8A and 8B).

The auxiliary roller 36 is an electrically-conductive roller. As shown in FIG. 1, the auxiliary roller 36 is disposed downstream of the first-transfer roller 34G and upstream of the first-transfer roller 34Y in the rotating direction of the transfer belt TB.

The auxiliary roller 36 is ground-connected to the frame (not shown) of the image forming apparatus 10. Therefore, the auxiliary roller 36 has a function of causing static electricity accumulated in the transfer belt TB to leak therefrom. The auxiliary roller 36 is an example of a ground-connected section.

Second-Transfer Unit

The second-transfer unit 38 has a function of transferring (second-transferring), at the nip N2, the toner images G transferred (first-transferred) on the transfer belt TB onto a medium P transported to the nip N2.

As shown in FIG. 1, the second-transfer unit 38 includes an electrically-conductive roller 38A and a backup roller 38B.

The electrically-conductive roller 38A rotates about a shaft by being driven by a driving source (not shown). The electrically-conductive roller 38A is ground-connected to the frame (not shown) of the image forming apparatus 10. The backup roller 38B (which will be referred to as "BUR 38B" hereinafter) is an electrically-conductive roller. The BUR 38B is disposed opposite the electrically-conductive roller 38A with the transfer belt TB interposed therebetween. The BUR 38B sandwiches the transfer belt TB together with the electrically-conductive roller 38A so as to form the nip N2 at the transfer belt TB. When voltage (second-transfer voltage) is applied to the BUR 38B from the power supply PS, the second-transfer unit 38 transfers (second-transfers) the toner images G from the transfer belt TB to a medium P passing through the nip N2. The second-transfer voltage in this exemplary embodiment is, for example, voltage with a negative polarity.

Transport Device

The transport device 40 has a function of transporting a medium P. As shown in FIG. 1, the transport device 40 transports the medium P in a transport direction CD.

Fixing Device

The fixing device 50 has a function of applying heat and pressure onto the toner T, which constitutes the toner images G second-transferred on the medium P by the transfer device 30, at a nip N3 so as to fix the toner T onto the medium P. The fixing device 50 includes a heating roller 50A and a pressing roller 50B. The heating roller 50A and the pressing roller 50B are disposed such that axial directions thereof are parallel to each other. The pressing roller 50B applies pressure onto the heating roller 50A so as to form the nip N3.

Controller

The controller 60 has a function of controlling sections other than the controller 60 constituting the image forming apparatus 10 (which will be referred to as "sections other than the controller 60" hereinafter). As mentioned above, the controller 60 includes the controller 60A of the transfer device 30, and the controller 60A controls components other than the controller 60A in the transfer device 30. The ten kinds of modes (i.e., first to tenth modes) mentioned above will now be described with reference to FIG. 3. Each of the modes is executed by the controller 60A that has received data for controlling the transfer device 30 from the controller 60 that has received job data from an external apparatus (not shown). Furthermore, the job data contains image data for making the monochromatic units 21 form the toner images G, data related to the number of sheets, and other data used for the image forming operation.

First Mode

In the first mode, the controller 60 causes the toner-image forming section 20 to form only the toner images G2. When executing the first mode, the controller 60A sets the first-transfer rollers 34 of the monochromatic units 21 that form the toner images G2, which are the monochromatic units 21 other than the monochromatic unit 21G, at their operation positions. Furthermore, the power supply PS is controlled by the controller 60A so as to apply a reference electric current I1 (e.g., a current value of 45 μA) to the first-transfer rollers 34. Then, the toner images G2 alone are first-transferred onto the transfer belt TB. In the first mode, the controller 60A maintains the first-transfer roller 34G at its standby position while controlling the power supply PS to not apply an electric current to the first-transfer roller 34G.

Second Mode

In the second mode, the controller 60 causes the toner-image forming section 20 to form only the toner image G1. When executing the second mode, the controller 60A sets the first-transfer roller 34G of the monochromatic unit 21G at its operation position. Furthermore, the power supply PS is controlled by the controller 60A so as apply an electric current I2 (e.g., a current value of 22.5 μA), which is lower than the reference electric current I1, to the first-transfer roller 34G. Then, the toner image G1 alone is first-transferred onto the transfer belt TB. In the second mode, the controller 60A maintains the first-transfer rollers 34 other than the first-transfer roller 34G at their standby positions while controlling the power supply PS to not apply an electric current to the first-transfer rollers 34 other than the first-transfer roller 34G.

Third Mode

In the third mode, the controller 60 causes the toner-image forming section 20 to form the toner image G1 and the toner images G2. When executing the third mode, the controller 60A sets all of the first-transfer rollers 34 at their operation positions. Furthermore, the power supply PS is controlled by the controller 60A so as to apply the electric current I2, which is lower than the reference electric current I1, to the first-transfer roller 34G. Moreover, the power supply PS is controlled by the controller 60A so as to apply the reference electric current I1 to the first-transfer rollers 34 other than the first-transfer roller 34G. Then, the toner image G1 and the toner images G2 are first-transferred onto the transfer belt TB.

Fourth Mode

In the fourth mode, the controller 60 causes the toner-image forming section 20 to form only the toner image G1. When executing the fourth mode, the controller 60A controls the first-transfer rollers 34 and the power supply PS in a manner similar to the third mode. Then, the toner image G1 alone is first-transferred onto the transfer belt TB.

Fifth Mode

In the fifth mode, the controller 60 causes the toner-image forming section 20 to form the toner image G1 and the toner images G2. When executing the fifth mode, the controller 60A sets all of the first-transfer rollers 34 at their operation positions. Furthermore, the power supply PS is controlled by the controller 60A so as to apply the electric current I2, which is lower than the reference electric current I1, to the first-transfer roller 34G. Moreover, the power supply PS is controlled by the controller 60A so as to apply an electric current I3, which is higher than the reference electric current I1, to the first-transfer rollers 34 other than the first-transfer roller 34G. Then, the toner image G1 and the toner images G2 are first-transferred onto the transfer belt TB.

Sixth Mode

In the sixth mode, the controller 60 causes the toner-image forming section 20 to form only the toner image G1. When executing the sixth mode, the controller 60A controls the first-transfer rollers 34 and the power supply PS in a manner similar to the fifth mode. Then, the toner image G1 alone is first-transferred onto the transfer belt TB.

Seventh Mode

In the seventh mode, the controller 60 causes the toner-image forming section 20 to form the toner image G1 and the toner images G2. When executing the seventh mode, the controller 60A sets all of the first-transfer rollers 34 at their operation positions. Furthermore, the power supply PS is controlled by the controller 60A so as to apply an electric current I4, which is lower than the reference electric current I1, to the first-transfer roller 34G. Moreover, the power supply PS is controlled by the controller 60A so as to cause the electric current I2, which is lower than the reference electric current I1 and is higher than the electric current I4, to the first-transfer rollers 34 other than the first-transfer roller 34G. Then, the toner image G1 and the toner images G2 are first-transferred onto the transfer belt TB.

Eighth Mode

In the eighth mode, the controller 60 causes the toner-image forming section 20 to form only the toner image G1. When executing the eighth mode, the controller 60A controls the first-transfer rollers 34 and the power supply PS in a manner similar to the seventh mode. Then, the toner image G1 alone is first-transferred onto the transfer belt TB.

Ninth Mode

In the ninth mode, the controller 60 causes the toner-image forming section 20 to form the toner image G1 and the toner images G2. When executing the ninth mode, the controller 60A sets all of the first-transfer rollers 34 at their operation positions. Furthermore, the power supply PS is controlled by the controller 60A so as to apply the reference electric current I1 to the first-transfer roller 34G. Moreover, the power supply PS is controlled by the controller 60A so as to apply an electric current I5, which is higher than the reference electric current I1, to the first-transfer rollers 34 other than the first-transfer roller 34G. Then, the toner image G1 and the toner images G2 are first-transferred onto the transfer belt TB.

Tenth Mode

In the tenth mode, the controller 60 causes the toner-image forming section 20 to form only the toner image G1. When executing the tenth mode, the controller 60A controls the first-transfer rollers 34 and the power supply PS in a manner similar to the ninth mode. Then, the toner image G1 alone is first-transferred onto the transfer belt TB.

The overall configuration of the image forming apparatus 10 according to this exemplary embodiment has been described above.

Toners

Next, the toners used in the image forming apparatus 10 will be described with reference to FIGS. 4 and 5.

Flat Toner (Toner MT)

Figure 4:
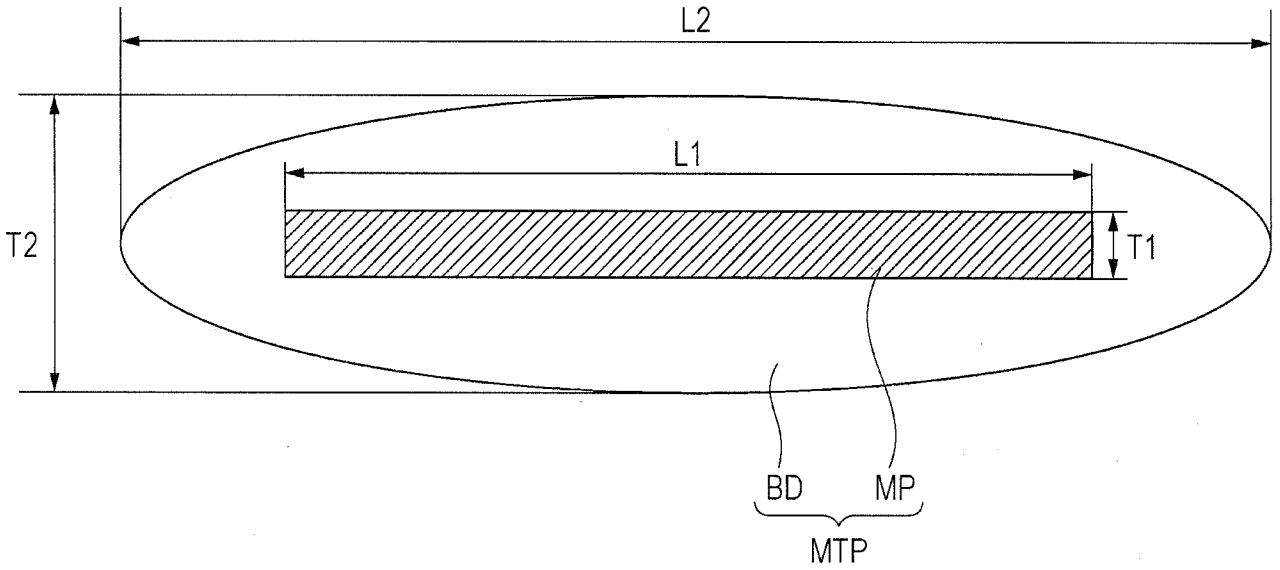
FIG. 4 is a cross-sectional view schematically illustrating a flat-toner particle used in the image forming apparatus according to the exemplary embodiment.

As shown in FIG. 4, each of toner particles MTP constituting the toner MT contains, for example, a metallic pigment MP and a binder BD. The binder BD covers the metallic pigment MP. The metallic pigment MP is flat. Specifically, for example, the metallic pigment MP has a length L1 ranging between 5 μm and 12 μm along the longitudinal axis thereof, and a thickness T1 ranging between 0.01 μm and 0.5 μm. The length L1 along the longitudinal axis refers to the length of the longest portion of the metallic pigment MP when the metallic pigment MP is viewed from a direction orthogonal to the thickness direction of the metallic pigment MP. For example, each toner particle MTP in this exemplary embodiment has a length L2 ranging between 7 μm and 20 μm along the longitudinal axis thereof, and a thickness T2 ranging between 1 μm and 3 μm. The length L2 along the longitudinal axis refers to the length of the longest portion of the toner particle MTP when the toner particle MTP is viewed from a direction orthogonal to the thickness direction of the toner particle MTP. Accordingly, each toner particle MTP in this exemplary embodiment is a toner particle in which the ratio of the length L1 to the thickness T1 of the contained metallic pigment MP ranges between, for example, 10 and 1200, and the ratio of the length L2 to the thickness T2 of the toner particle MTP ranges between, for example, 2.3 and 20. The toner MT in this exemplary embodiment is an aggregate of toner particles MTP having the above-described relationship. Although the toner MT in this exemplary embodiment is gold-colored as described above, the metallic pigment MP constituting each toner particle MTP is composed of, for example, aluminum, and the toner MT is given the gold color by distributing, for example, yellow (Y) pigments to the binder BD.

Non-Flat Toner (Toner NT)

Figure 5:
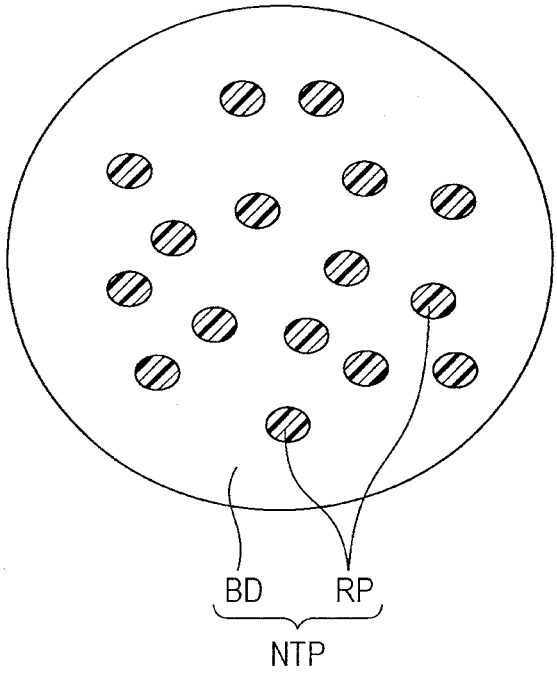
FIG. 5 is a cross-sectional view schematically illustrating a non-flat toner particle used in the image forming apparatus according to the exemplary embodiment.

As shown in FIG. 5, each of toner particles NTP constituting the toner NT contains, for example, a resinous pigment RP and a binder BD. The toner particle NTP is non-flat. Specifically, each toner particle NTP in this exemplary embodiment is a toner particle in which, for example, the ratio of the length of the contained resinous pigment RP along the longitudinal axis thereof to the thickness thereof is smaller than 10, and the length of the toner particle NTP along the longitudinal axis thereof to the thickness thereof is smaller than 2.3. The degree of circularity of the toner particle NTP in this exemplary embodiment when projected onto a plane is, for example, 0.90 or greater. Accordingly, the toner particles NTP (toner NT) in this exemplary embodiment are non-flat toner particles (toner).

The toners MT and NT used in the image forming apparatus 10 according to this exemplary embodiment have been described above.

Supplements

Supplement 1

Figure 6:
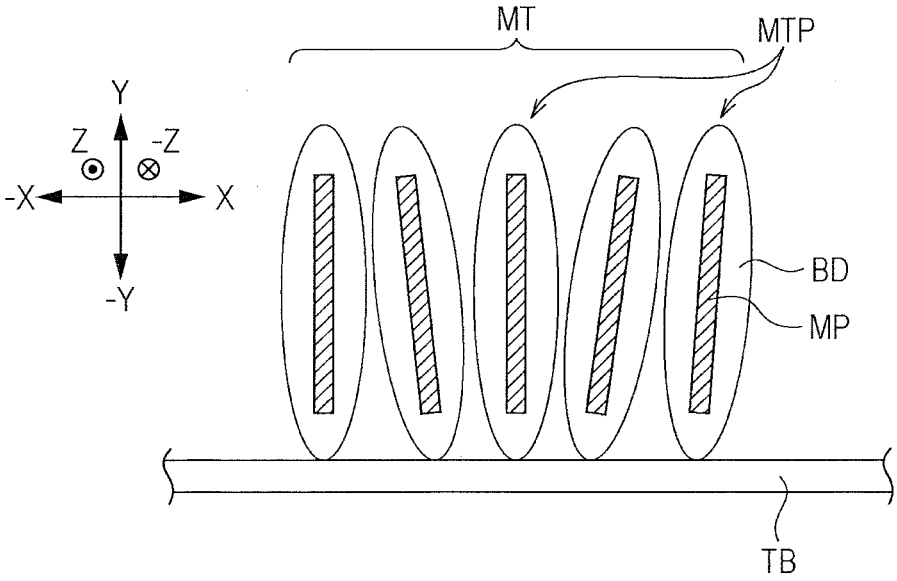
FIG. 6 schematically illustrates a state where the flat toner is carried by a transfer belt.

As shown in FIG. 6, during a period in which the toner MT moves together with the transfer belt TB through locations other than the nips N1 and N2, the toner MT is adhered to the transfer belt TB in a standing state in which the longitudinal axis of the toner MT is substantially orthogonal to the outer periphery of the transfer belt TB. This is because the toner MT is polarized in the direction of the longitudinal axis thereof.

Supplement 2

The image forming apparatus 10 according to this exemplary embodiment forms the toner image G1 by using the monochromatic unit 21G so as to form an image having the flat metallic pigments MP as a colorant element. Accordingly, an image formed using the toner MT constituted of the toner particles MTP containing such flat metallic pigments MP reflects light and produces a metallic luster. Image Forming Operation of Image Forming Apparatus Next, the image forming operation of the image forming apparatus 10 according to this exemplary embodiment will be described with reference to the drawings.

The controller 60 that has received job data from an external apparatus (not shown) actuates the toner-image forming section 20, the transfer device 30, and the fixing device 50, which are sections other than the controller 60. As described above, the transfer device 30 is controlled by the controller 60A that has received data for controlling the transfer device 30 from the controller 60.

The controller 60 causes the charging devices 24 to electrostatically charge the photoconductors 22, causes the exposure devices 26 to expose the photoconductors 22 to light, and causes the developing devices 28 to develop the toner images G, thereby causing the monochromatic units 21 to form the toner images G. The controller 60A sets the first-transfer rollers 34 at their operation positions by using cams in accordance with each mode and causes the power supply PS to apply first-transfer voltage to the first-transfer rollers 34, thereby causing an electric current corresponding to each mode to flow through the first-transfer rollers 34. As a result, the toner images G formed by the monochromatic units 21 are first-transferred onto the rotating transfer belt TB at the nips N1.

Subsequently, the controller 60 causes the transport device 40 to transport a medium P toward the nip N2 in accordance with a timing at which the toner images G on the transfer belt TB reach the nip N2 together with the transfer belt TB. Then, the controller 60 causes the power supply PS to apply second-transfer voltage to the BUR 38B. As a result, the toner images G on the transfer belt TB are second-transferred onto the medium P passing through the nip N2.

Subsequently, the controller 60 causes the transport device 40 to transport the medium P toward the nip N3 of the fixing device 50. As a result, the toner T constituting the toner images G second-transferred on the medium P is heated by the heating roller 50A and pressed by the pressing roller 50B, so that the toner images G on the medium P become fixed onto the medium P. Then, the medium P having the toner images G fixed thereon (i.e., the medium P having an image formed thereon) is discharged outside the image forming apparatus 10 by the transport device 40, and the image forming operation of the image forming apparatus 10 ends.

Effects

Next, the effects (i.e., first to fourth effects) of this exemplary embodiment will be described with reference to the drawings.

First Effect

A first effect will be described by comparing the transfer device 30 and the image forming apparatus 10 according to this exemplary embodiment with a transfer device and an image forming apparatus (which are not shown) according to a comparative example to be described below. In the following description, if components identical to those used in the exemplary embodiment are used in the comparative example, the reference characters of those components will be used.

In the transfer device according to the comparative example, a first-transfer roller 34 other than the first-transfer rollers 34 that perform the first-transfer process is set at the standby position and is not supplied with the first-transfer voltage from the power supply PS. The first-transfer rollers 34 that perform the first-transfer process all receive the reference electric current I1. Other than the aforementioned point, the transfer device according to the comparative example has a configuration similar to that of the transfer device 30 according to the exemplary embodiment. Furthermore, other than the fact that the image forming apparatus according to the comparative example includes the transfer device according to the comparative example in place of the transfer device 30 according to the exemplary embodiment, the image forming apparatus according to the comparative example has a configuration similar to that of the image forming apparatus 10 according to the exemplary embodiment.

Figure 7:
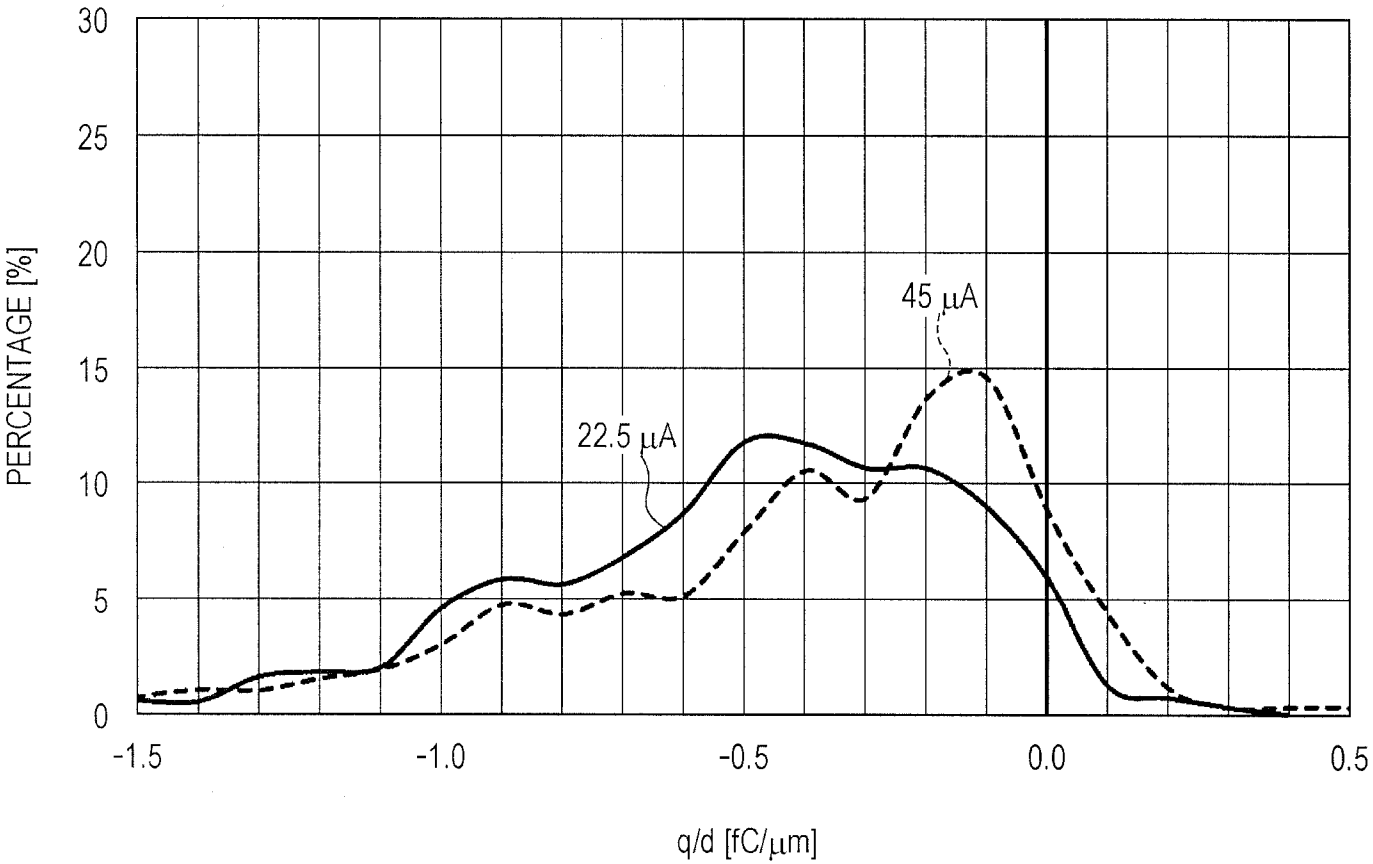
FIG. 7 is a graph illustrating electric-charge distribution of the flat toner immediately after a toner image formed of the flat toner is first-transferred onto the transfer belt from a photoconductor, and compares a case where the first-transfer electric current is 45 μA (reference electric current) and a case where the first-transfer electric current is 22.5 μA (which is lower than the reference electric current)
Figure 8A:
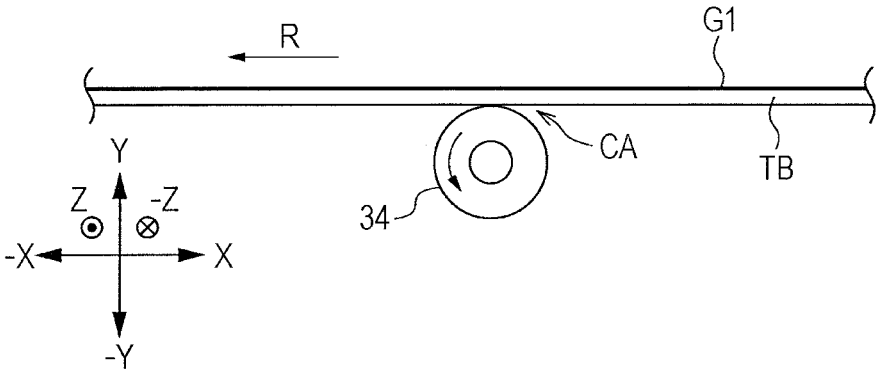
FIGS. 8A and 8B illustrate a state where the toner image formed of the flat toner and first-transferred on the transfer belt according to the exemplary embodiment is traveling near an auxiliary roller together with the transfer belt, FIG. 8A being a schematic diagram viewed from the front side in an apparatus depth direction, FIG. 8B being a schematic diagram viewed from above in an apparatus height direction.
Figure 8B:
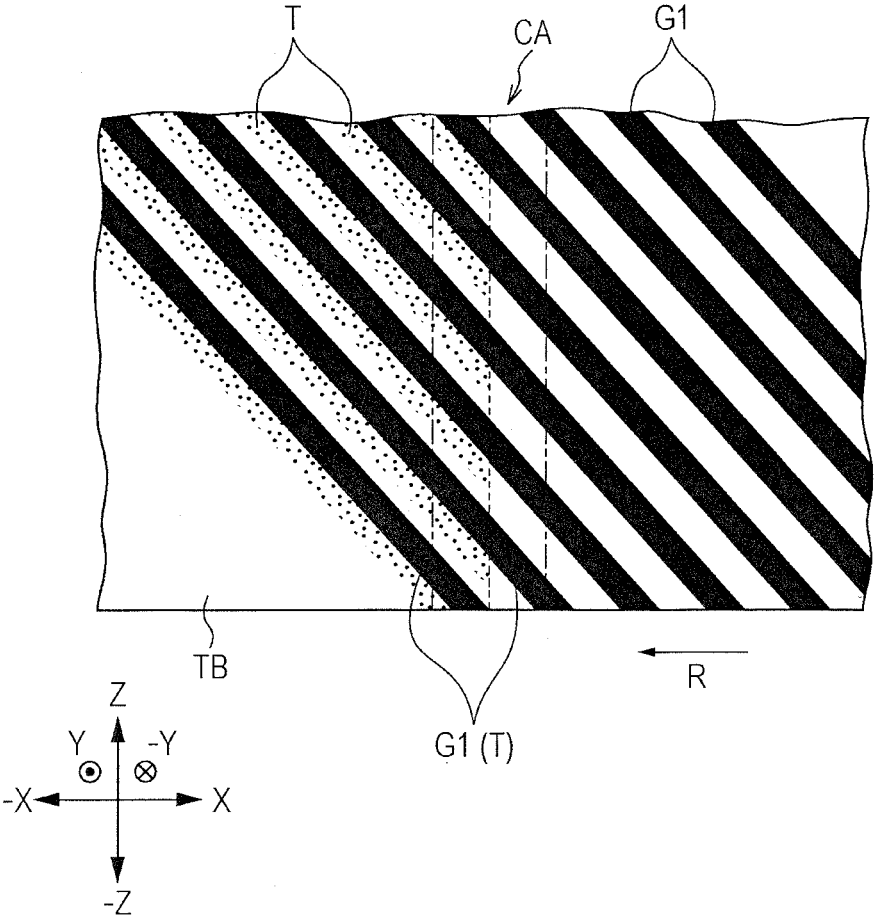
Figure 9:
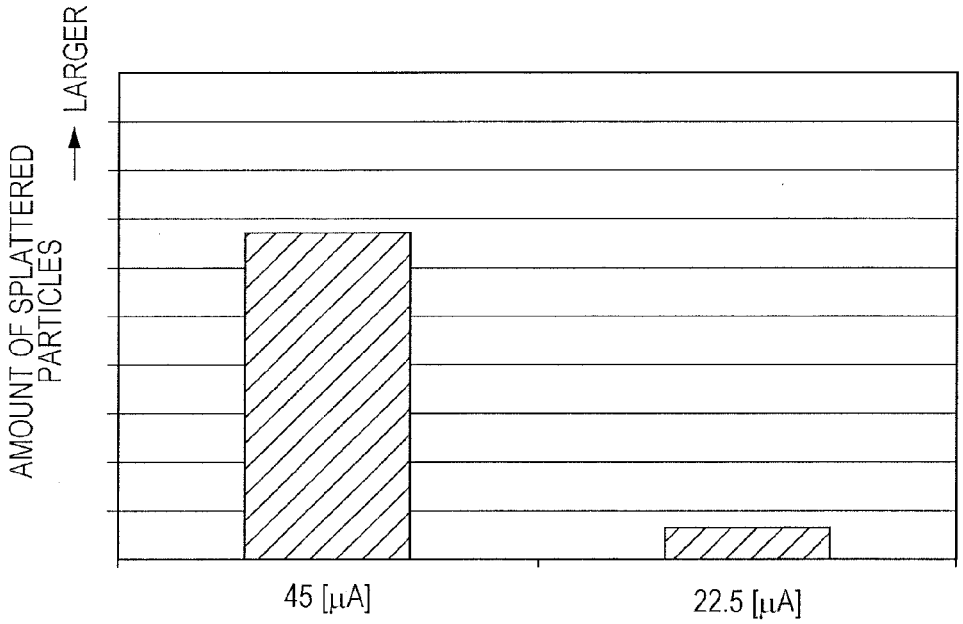
FIG. 9 is a graph illustrating the amount of splattered flat-toner particles after the toner image formed of the flat toner used by the image forming apparatus according to the exemplary embodiment and first-transferred on the transfer belt from the photoconductor travels together with the transfer belt and passes the auxiliary roller, and compares a case where the first-transfer electric current is 45 μA (reference electric current) and a case where the first-transfer electric current is 22.5 μA (which is lower than the reference electric current)
Figure 10:
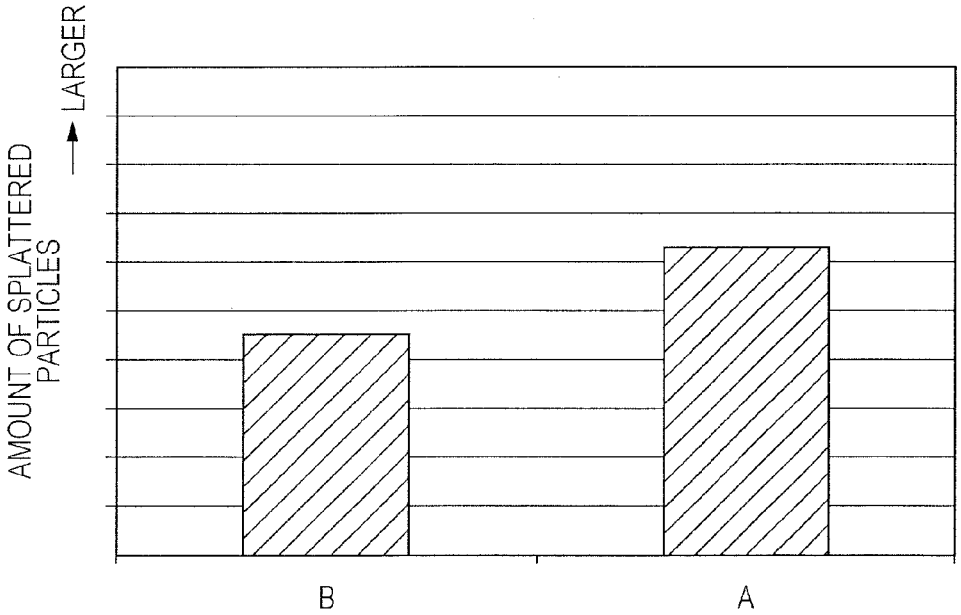
FIG. 10 is a graph that compares the amount of splattered flat-toner particles after the toner image formed of the flat toner used by the image forming apparatus according to the exemplary embodiment and first-transferred on the transfer belt from the photoconductor moves together with the transfer belt and passes the auxiliary roller (A in FIG. 10) and the amount of splattered flat-toner particles after the toner image passes a first-transfer roller located most downstream in a rotating direction of the transfer belt.

The following description relates to a case where the toner image G1 is first-transferred onto the transfer belt TB by using the transfer device according to the comparative example, that is, a case where the toner image G1 is first-transferred onto the transfer belt TB by applying the reference electric current I1 to the first-transfer roller 34G. In FIG. 7, a dashed line denotes electric-charge distribution before the toner MT constituting the toner image G1 first-transferred on the transfer belt TB reaches the contact area CA. As shown in FIG. 7, the toner MT contains toner particles MTP with low charge (i.e., a state of charge amount in which the polarity is close to zero). As an area in the transfer belt TB having the toner particles MTP adhered thereto reaches the contact area CA and (a portion of) positive-polarity static electricity in this area is leaked by the auxiliary roller 36, an adhesive force (electrostatic attraction force) that causes the toner particles MTP to adhere to this area decreases. Then, since low-charge toner particles MTP of the toner particles MTP have relatively weak adhesive force to the transfer belt TB, the low-charge toner particles MTP tend to separate easily from the transfer belt TB due to electrical repulsive force acting between adjacent toner particles MTP. As a result, the aforementioned low-charge toner particles MTP may possibly splatter on the transfer belt TB as they pass through the contact area CA. FIGS. 8A and 8B schematically illustrate a case where the toner image G1 formed on the transfer belt TB has a pattern with multiple slanted lines relative to the rotating direction of the transfer belt TB. Furthermore, in a bar graph in FIG. 9, a graph denoted by 45 μA indicates the amount of toner particles MTP splattered per unit area when the toner image G1 is first-transferred onto the transfer belt TB by using the transfer device according to the comparative example (i.e., by applying the reference electric current I1 (=45 μA) to the first-transfer roller 34G) and subsequently passes through the contact area CA. Such splattering of the toner particles MTP may also possibly occur when using the toner NT (non-flat toner) different from the toner MT. However, the amount of toner particles NTP splattered per unit area when passing through the contact area CA is smaller than the amount of toner particles MTP splattered per unit area when passing through the contact area CA. It is assumed that this is due to the fact that the toner MT contains the metallic pigments MP and that the toner MT has a smaller contact area with the transfer belt TB than the toner NT because the toner MT is adhered to the transfer belt TB in a standing state, as mentioned above.

Figure 3:
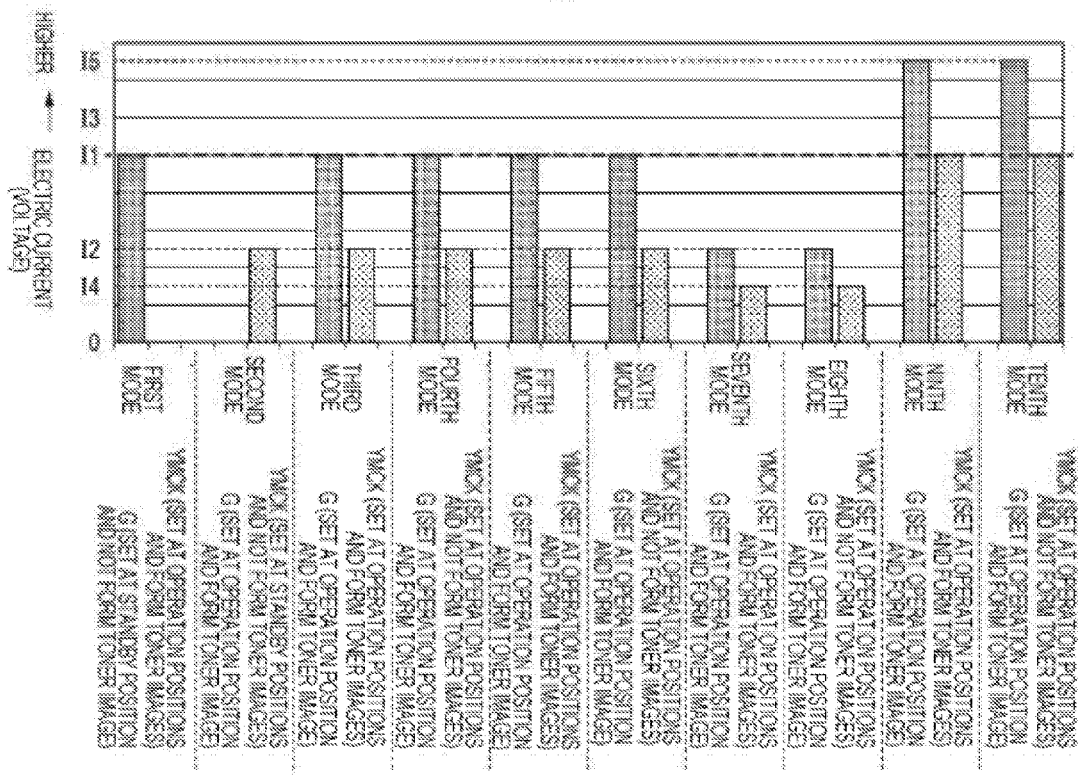
FIG. 3 is a graph illustrating the relationship among first-transfer electric currents to be applied to first-transfer rollers in various modes (first to tenth modes) executed when the transfer device according to the exemplary embodiment performs a transfer operation.

In contrast, as shown in FIG. 3, the transfer device 30 according to the exemplary embodiment is capable of performing the image forming operation (transfer operation) in the second to eighth modes. Therefore, in the transfer device 30 according to the exemplary embodiment, the electric current I2 applied to the first-transfer roller 34G when first-transferring the toner image G1 is lower than the reference electric current I1 applied to the first-transfer roller 34G by the transfer device according to the comparative example. The electric-charge distribution of the toner MT constituting the toner image G1 before the toner image G1 first-transferred on the transfer belt TB by the transfer device 30 according to the exemplary embodiment in any one of the third to sixth modes reaches the contact area CA is indicated by a solid line in FIG. 7. As shown in FIG. 7, the toner MT constituting the toner image G1 first-transferred by the transfer device 30 according to the exemplary embodiment in any one of the third to sixth modes has a smaller amount of low-charge toner particles MTP than the toner MT constituting the toner image G1 first-transferred by the transfer device according to the comparative example. In the bar graph in FIG. 9, a graph denoted by 22.5 μA indicates the amount of toner particles MTP splattered per unit area after the toner image G1 first-transferred on the transfer belt TB by using the transfer device 30 according to the exemplary embodiment (i.e., by applying the electric current I2 (=22.5 μA), which is lower than the reference electric current I1, to the first-transfer roller 34G) passes through the contact area CA. As shown in the bar graph in FIG. 9, the amount of toner particles MTP splattered per unit area in the case of the exemplary embodiment (electric current I2=22.5 μA) is smaller than that in the case of the comparative example (reference electric current I1=45 μA).

As shown in FIG. 3, in the case of the seventh and eighth modes, the electric current I4 applied to the first-transfer roller 34G is lower than the reference electric current I1 applied to the first-transfer roller 34G by the transfer device according to the comparative example. Therefore, the amount of toner particles MTP splattered per unit area when passing through the contact area CA in the seventh and eighth modes is smaller than the amount of toner particles MTP splattered per unit area when passing through the contact area CA in the comparative example.

Thus, in the transfer device 30 according to the exemplary embodiment, the amount of toner particles MTP splattered when the toner image G1 passes through the contact area CA (i.e., auxiliary roller 36) may be reduced, as compared with a transfer device in which the electric current applied to the first-transfer roller 34G is equal to the reference electric current I1 applied to the first-transfer rollers 34 other than the first-transfer roller 34G. Accordingly, when the image forming apparatus 10 according to the exemplary embodiment forms a G (gold) image, image defects caused by splattering of the toner particles MTP may be suppressed, as compared with an image forming apparatus equipped with a transfer device in which the electric current applied to the first-transfer roller 34G is equal to the reference electric current I1 applied to the first-transfer rollers 34 other than the first-transfer roller 34G.

Furthermore, in the transfer device 30 according to the exemplary embodiment, a difference between the amount of splattered toner particles MTP of the toner MT constituting the toner image G1 and the amount of splattered toner particles NTP of the toner NT constituting the toner images G2 may be reduced, as compared with the transfer device according to the comparative example. Accordingly, the image forming apparatus 10 according to the exemplary embodiment may form an image with a reduced difference between the amount of splattered toner particles MTP and the amount of splattered toner particles NTP, as compared with an image forming apparatus equipped with a transfer device in which the electric current applied to the first-transfer roller 34G is equal to the reference electric current I1 applied to the first-transfer rollers 34 other than the first-transfer roller 34G.

Second Effect

A second effect will be described below by comparing the transfer device 30 and the image forming apparatus 10 according to the exemplary embodiment with the transfer device and the image forming apparatus according to the above-described comparative example.

As described above, when the transfer device according to the comparative example transfers toner images G, a first-transfer roller 34 other than the first-transfer rollers 34 that perform the first-transfer process is set at the standby position and is not supplied with the first-transfer voltage from the power supply PS.

In contrast, as shown in FIG. 3, the transfer device 30 according to the exemplary embodiment is capable of performing the image forming operation (transfer operation) in the third and fourth modes. Furthermore, in the transfer device 30 according to the exemplary embodiment, the first-transfer rollers 34 (photoconductors 22) other than the first-transfer roller 34G (photoconductor 22G) are disposed downstream of the first-transfer roller 34G (photoconductor 22G) in the rotating direction of the transfer belt TB. Therefore, when transferring the toner image G1 in the third and fourth modes, the transfer device 30 according to the exemplary embodiment sets the first-transfer rollers 34 other than the first-transfer roller 34G at their operation positions and applies an electric current to the first-transfer rollers 34 other than the first-transfer roller 34G so that the toner particles MTP splattered when the toner image G1 passes through the contact area CA may be transported to the photoconductors 22 other than the photoconductor 22G. In this case, in the transfer device 30 according to the exemplary embodiment, the electric current (reference electric current I1) applied to the first-transfer rollers 34 other than the first-transfer roller 34G is higher than the electric current I2 applied to the first-transfer roller 34G, so that a larger amount of toner particles MTP splattered when the toner image G1 passes through the contact area CA may be transported to the photoconductors 22 other than the photoconductor 22G.

Therefore, when the transfer device 30 according to the exemplary embodiment transfers the toner image G1 in the third and fourth modes, the toner particles MTP splattered when the toner image G1 passes through the contact area CA may be transported to the photoconductors 22 other than the photoconductor 22G, as compared with a transfer device that sets the first-transfer rollers 34 other than the first-transfer roller 34G at their standby positions. Accordingly, when the image forming apparatus 10 according to the exemplary embodiment forms a G (gold) image, image defects caused by splattering of the toner particles MTP may be suppressed, as compared with an image forming apparatus equipped with a transfer device that sets the first-transfer rollers 34 other than the first-transfer roller 34G at their standby positions.

Furthermore, as shown in FIG. 3, the transfer device 30 according to the exemplary embodiment is capable of performing the image forming operation (transfer operation) in the fifth and sixth modes. The electric current I3 applied to the first-transfer rollers 34 other than the first-transfer roller 34G in the fifth and sixth modes is higher than the reference electric current I1 applied to the first-transfer rollers 34 other than the first-transfer roller 34G in the third and fourth modes.

Therefore, when the transfer device 30 according to the exemplary embodiment transfers the toner image G1 in the fifth and sixth modes, the toner particles MTP splattered when the toner image G1 passes through the contact area CA are transported by a larger amount to the photoconductors 22 by the first-transfer rollers 34 other than the first-transfer roller 34G, as compared with a transfer device that applies the reference electric current I1 to the first-transfer rollers 34 other than the first-transfer roller 34G. Accordingly, when the image forming apparatus 10 according to the exemplary embodiment forms a G (gold) image in the fifth and sixth modes, image defects caused by splattering of the toner particles MTP may be suppressed, as compared with an image forming apparatus equipped with a transfer device that applies the reference electric current I1 to the first-transfer rollers 34 other than the first-transfer roller 34G.

Third Effect

A third effect (i.e., effect of the seventh and eighth modes) will now be described by being compared with the third and fourth modes.

As shown in FIG. 3, in the case of the seventh and eighth modes, the electric current I2 applied to the first-transfer rollers 34 other than the first-transfer roller 34G is lower than that in the third and fourth modes. Furthermore, in the case of the seventh and eighth modes, the electric current I4 applied to the first-transfer roller 34G is lower than that in the third and fourth modes. Therefore, in the transfer device 30 that transfers the toner image G1 in the seventh and eighth modes, the electric-charge distribution of the toner MT may less likely to be changed by the first-transfer rollers 34 other than the first-transfer roller 34G, as compared with the transfer device 30 that transfers the toner image G1 in the third and fourth modes.

Other Effects

An effect of the ninth and tenth modes will be described.

As shown in FIG. 3, in the case of the ninth and tenth modes, the electric current applied to the first-transfer roller 34G is the reference electric current I1, unlike in the case of the second to eighth modes. However, in the case of the ninth and tenth modes, the electric current applied to the first-transfer rollers 34 other than the first-transfer roller 34G is the electric current I5, which is higher than the reference electric current I1. Therefore, the effect of the ninth and tenth modes is similar to the effect of the first to third modes.

Although a specific exemplary embodiment of the present invention has been described in detail above, the present invention is not limited to the above exemplary embodiment, and other exemplary embodiments are possible within the technical scope of the present invention.

For example, in the above exemplary embodiment, the controller 60A sets all of the first-transfer rollers 34 at their operation positions in the fourth, sixth, eighth, and tenth modes, and the power supply PS controlled by the controller 60A applies an electric current to all of the first-transfer rollers 34. Alternatively, without having to set all of the first-transfer rollers 34 at their operation positions and applying an electric current thereto, at least one of the first-transfer rollers 34 other than the first-transfer roller 34G may be set at its operation position, and an electric current that satisfies the conditions of each mode may be applied thereto.

Furthermore, in the above exemplary embodiment, the controller 60A sets all of the first-transfer rollers 34 at their operation positions in the third, fifth, seventh, and ninth modes, and the power supply PS controlled by the controller 60A applies an electric current to all of the first-transfer rollers 34. Alternatively, without having to set all of the first-transfer rollers 34 at their operation positions and applying an electric current thereto, at least the first-transfer rollers 34 that transfer the toner images G2 among the first-transfer rollers 34 other than the first-transfer roller 34G may be set at their operation positions, and an electric current that satisfies the conditions of each mode may be applied thereto.

Furthermore, in the above exemplary embodiment, the electric current applied to the first-transfer rollers 34 in the first mode is set as the reference electric current I1, and the electric currents I1, 12, 13, 14, and 15 that satisfy the conditions of the respective modes are applied to the first-transfer rollers 34 in the second to tenth modes. In the description of the exemplary embodiment, for example, the electric current I2 applied to the first-transfer roller 34G in the third and fourth modes is the same as the electric current I2 applied to the first-transfer roller 34G in the fifth and sixth modes and to the first-transfer rollers 34 other than the first-transfer roller 34G in the seventh and eighth modes. However, applying the same electric current I2 in these modes is exemplary. The electric current applied to the first-transfer rollers 34 in each mode is not limited to I1, 12, 13, 14, and 15 so long as the electric current applied to the first-transfer rollers 34 other than the first-transfer roller 34G is lower than the electric current applied to the first-transfer roller 34G in each mode and the magnitude relationship with respect to the reference electric current I1 is satisfied in each mode.

Furthermore, the auxiliary roller 36 according to the above exemplary embodiment is described as being ground-connected to the frame of the image forming apparatus 10. However, the auxiliary roller 36 does not have to be ground-connected to the frame so long as it has a function of causing static electricity accumulated in the transfer belt TB to leak therefrom. For example, the auxiliary roller 36 may be supplied with a specific voltage.

Furthermore, the auxiliary roller 36 is described as being disposed downstream of the first-transfer roller 34G and upstream of the first-transfer roller 34Y in the rotating direction of the transfer belt TB. However, the auxiliary roller 36 does not have to be disposed upstream of the first-transfer roller 34Y so long as the auxiliary roller 36 is disposed downstream of the first-transfer roller 34G and upstream of the nip N2 in the rotating direction of the transfer belt TB. For example, the auxiliary roller 36 may alternatively be disposed downstream of the first-transfer roller 34M and upstream of the first-transfer roller 34C.

Furthermore, the transfer device 30 according to the above exemplary embodiment is described as having ten kinds of modes. Alternatively, the transfer device 30 according to the exemplary embodiment may at least have the first mode and any of the modes other than the first mode. For example, the transfer device 30 according to the exemplary embodiment may have the first mode and any one of the combinations of the third and fourth modes, the fifth and sixth modes, the seventh and eighth modes, and the ninth and tenth modes. With this combination, the transfer efficiency when transferring the toner image G1 and the toner images G2 and the transfer efficiency when transferring the toner image G1 alone are made equal to each other.

Furthermore, the toner MT used in the image forming apparatus 10 according to the above exemplary embodiment is described as being gold-colored. However, the toner MT does not have to be gold-colored so long as the toner MT is a flat toner containing metallic pigments. For example, the toner MT may be silver-colored.

Furthermore, as shown in FIG. 1, in the image forming apparatus 10 according to the exemplary embodiment, it is described that the first-transfer roller 34G is disposed most upstream of all of the first-transfer rollers 34 with reference to the nip N2 in the rotating direction of the transfer belt TB. However, the first-transfer roller 34G does not have to be disposed most upstream in the rotating direction of the transfer belt TB. For example, the first-transfer roller 34G may be disposed most downstream of all of the first-transfer rollers 34 with reference to the nip N2 in the rotating direction of the transfer belt TB.

Furthermore, in the image forming apparatus 10 according to the above exemplary embodiment, it is described that the BUR 38B is supplied with the second-transfer voltage, and the electrically-conductive roller 38A constituting the second-transfer unit 38 is connected to ground. Alternatively, the second-transfer unit 38 may be supplied with the second-transfer voltage, and the BUR 38B may be connected to ground.

Furthermore, it is described that the controller 60A of the image forming apparatus 10 according to the above exemplary embodiment controls the electric current to be applied to the first-transfer rollers 34. Alternatively, the controller 60 may control the voltage to be applied to the first-transfer rollers 34 so long as an electric current that satisfies the conditions of each mode is applied to the first-transfer rollers 34.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

an endless rotating member configured to rotate;

a first transfer section configured to transfer a first toner image, which is formed by a first forming unit by using a flat toner containing a flat metallic pigment, onto an outer periphery of the rotating member;

a second transfer section configured to transfer a second toner image, which is formed by a second forming unit by using a non-flat toner, onto the outer periphery;

a ground-connected section that is disposed downstream of the first transfer section in a rotating direction of the endless rotating member and that is connected to ground by being in contact with an inner periphery of the endless rotating member; and a power supply configured to apply a first electric current to the first transfer section, which is lower than a second electric current applied to the second transfer section, when the first transfer section transfers the first toner image onto the outer periphery, wherein the first and the second toner images are transferred to a medium after being transferred onto the endless rotating member by the first and the second electric currents.

2. The transfer device according to claim 1, wherein the second transfer section is disposed downstream of the first transfer section in the rotating direction, wherein the ground-connected section is disposed upstream of the second transfer section in the rotating direction, and wherein the power supply configured to apply a reference electric current to the second transfer section when the second toner image is to be transferred onto the outer periphery by the second transfer section alone, and configured to apply an electric current lower than the reference electric current to the first transfer section when the first toner image is to be transferred onto the outer periphery by the first transfer section.

3. An image forming apparatus comprising:

the first forming unit that forms the first toner image by using the flat toner containing the flat metallic pigment;

the second forming unit that forms the second toner image by using the non-flat toner; and the transfer device according to claim 1 comprising a second-transfer unit configured to transfer the first and second toner images transferred on the endless rotating member onto a medium.

4. The transfer device according to claim 1, wherein when the first transfer section transfers the first toner image onto the outer periphery, the power supply is configured to apply the first electric current only to the first transfer section out of the first and the second transfer sections, which is lower than the second electric current which is only applied to the second transfer section out of the first and the second transfer sections.

5. The transfer device according to claim 1, wherein the first and the second toner images are transferred to the medium together after being transferred onto the endless rotating member by the first and the second electric currents.

6. A transfer device comprising:

an endless rotating member configured to rotate;

a first transfer section configured to transfer a first toner image, which is formed by a first forming unit by using a flat toner containing a flat metallic pigment, onto an outer periphery of the rotating member;

a second transfer section configured to transfer a second toner image, which is formed by a second forming unit by using a non-flat toner, onto the outer periphery;

a ground-connected section that is disposed downstream of the first transfer section in a rotating direction of the endless rotating member and that is connected to ground by being in contact with an inner periphery of the endless rotating member; and a power supply configured to apply a reference electric current to the second transfer section when the second toner image is to be transferred onto the outer periphery by the second transfer section alone, and configured to apply a lower electric current lower than the reference electric current to the first transfer section when the first toner image is to be transferred onto the outer periphery by the first transfer section, wherein the first and the second toner images are transferred to a medium after being transferred onto the endless rotating member by the reference electric current and the lower electric current.

7. The transfer device according to claim 6, wherein the power supply is configured to apply the reference electric current only to the second transfer section out of the first and the second transfer sections when the second toner image is to be transferred onto the outer periphery by the second transfer section alone, and configured to apply the lower electric current lower than the reference electric current only to the first transfer section out of the first and the second transfer sections when the first toner image is to be transferred onto the outer periphery by the first transfer section.

8. The transfer device according to claim 3, wherein the first and the second toner images are transferred together to the medium after being transferred onto the endless rotating member by the reference electric current and the lower electric current.

* * * * *